United States Patent [19]

Leibowitz

[11] Patent Number: 4,517,770

[45] Date of Patent: May 21, 1985

[54] GEMSTONE POLISHING MACHINE

[76] Inventor: Alec Leibowitz, 16c, Mutual Pl., Beach Rd., Seapoint, Cape Town, South Africa

[21] Appl. No.: 661,285

[22] Filed: Oct. 17, 1984

Related U.S. Application Data

[63] Continuation of Ser. No. 353,912, Mar. 2, 1982, abandoned.

[30] Foreign Application Priority Data

Aug. 10, 1981 [ZA] South Africa ..... 81/8466
Aug. 11, 1981 [GB] United Kingdom ..... 8124446

[51] Int. Cl.[3] ..... B24B 9/16
[52] U.S. Cl. ..... 51/125.5; 51/229
[58] Field of Search ..... 51/101 R, 122, 124 R, 51/125, 125.5, 165.79, 165.89, 229, 234, 283 R

[56] References Cited

U.S. PATENT DOCUMENTS

| | | | |
|---|---|---|---|
| 740,902 | 10/1903 | Oostendorp | 51/229 |
| 886,310 | 4/1908 | Wennstrom | 51/234 X |
| 1,103,698 | 7/1914 | Soetens . | |
| 1,124,883 | 1/1915 | Folscheid | 51/125 X |
| 1,227,243 | 5/1917 | Bugbee | 51/101 R |
| 1,504,358 | 8/1924 | Leperre . | |
| 2,356,184 | 8/1944 | Simons | 51/122 |
| 2,440,464 | 4/1948 | Ewaldson | 51/165.79 X |
| 2,444,795 | 7/1948 | Weir | 51/229 |
| 3,073,085 | 1/1963 | Ticino | 51/229 |
| 3,624,968 | 12/1971 | Leibowitz | 51/229 X |
| 3,811,229 | 5/1974 | Montgomery | 51/125 |
| 3,902,283 | 9/1975 | Bean | 51/125.5 |
| 4,106,240 | 8/1978 | DeBartolo | 51/229 X |
| 4,237,658 | 12/1980 | Stark | 51/229 X |

FOREIGN PATENT DOCUMENTS

| | | |
|---|---|---|
| 4190 | 8/1919 | Netherlands . |
| 564074 | 9/1944 | United Kingdom . |
| 1206937 | 9/1970 | United Kingdom . |
| 2037196A | 7/1980 | United Kingdom . |

*Primary Examiner*—Robert P. Olszewski
*Attorney, Agent, or Firm*—Shapiro and Shapiro

[57] ABSTRACT

In a gemstone blocking or polishing machine, a stone holder is supported in a gimbal so that it can pivot about two perpendicular axes, the holder also being capable of rotation about its own axis. The outer ring of the gimbal is in the form of a gear ring which can be indexed, and the holder passes through a slot in a grain ring which controls the orientation of the holder and can be locked to the gear ring by a clutch. In order to change the facet, the gear ring alone is indexed, forcing the holder to twist about its axis. In order to change the grain orientation, the gear ring and the grain ring are indexed synchronously. In order to signal when the facet has been worked to a sufficient depth, an electrical contact is made between the top end of the holder and a horizontal contact bar. The position of the holder is controlled by a spring.

18 Claims, 10 Drawing Figures

| FACET NO. | GRAIN-CHANGE ANGLE | FACET-CHANGE ANGLE | TOTAL | MICROSWITCHES 72 | 73 | 77 | 78 |
|---|---|---|---|---|---|---|---|
| 1 | 0° | 0° | 0° | C O | O C | O C | C O |
| 2 | 0° | 90° | 90° | C O | O C | O C | C O |
| 3 | 0° | 90° | 180° | C O | O C | O C | C O |
| 4 | 0° | 90° | 270° | C O | O C | O C | C O |
| 5 | 225° | 53° | 188° | O C | O C | C O | O C |
| 6 | 0° | 74° | 262° | O C | O C | C O | O C |
| 7 | 0° | 106° | 8° | O C | O C | C O | O C |
| 8 | 0° | 74° | 82° | O C | O C | C O | O C |

GEMSTONE POLISHING MACHINE

This is a continuation application of Ser. No. 353,912, filed Mar. 2, 1982, now abandoned.

BACKGROUND OF THE INVENTION

The present invention relates to gemstone polishing machines for working facets on a gemstone or the like. As used herein, the expression "gemstone or the like" includes natural or synthetic gemstones or semi-precious stones.

When working facets on gemstones, the greatest difficulties are encountered with diamonds because of their extreme hardness and also because of the effect of grain as discussed below. Thus, although the invention relates generally to gemstones, the detailed discussion of the invention is made with reference to diamonds. Generally, if a polishing machine can be used for diamonds, it can be used for any other gemstone, whether natural or synthetic.

Normal practice when working facets is to use a moving working member which contacts the stone in a working plane, and at the present time, the working member is normally in the form of a wheel or disc called a scaife, made of thick cast iron, of a diameter usually rather greater than 30 cm and usually rotating at 2,000–5,000 r.p.m., normally about 3,000 r.p.m. A gemstone polishing unit comprises means for holding and driving a moving working member and at least one polishing machine—there may for instance be four polishing machines spaced around a scaife.

The expression "working facets" is used to cover different but similar operations, namely grinding, blocking and polishing. Blocking is the removal of the bulk of the surplus material on the bottom (culet side) of a sawn stone, frequently prior to rebruting, with the intention of subsequently polishing all the bottom facets. In the art, a machine is called a polishing machine even if it is only used for grinding or blocking. Polishing is the formation of the finished facets on the top (table side) or bottom—there is for instance in GB Pat. No. 1 206 937 a good description of the finished facets on the bottom of a diamond.

When working the facets, the stone is held in a holder which normally is long-shaped with its axis substantially coincident with that of the stone. Thus, to work the facet, the holder will have its axis inclined to the working plane at an angle which determines the angle of the facet. Two movements are required of the holder, namely a movement about its own axis for changing the facet being worked (this is called changing the facet position), and movement about an axis normal to the working plane for changing the grain orientation. The phenomenon of grain in diamond working is well known, but is discussed for instance in GB Pat. No. 2 037 196A. It is necessary to present the facet to the scaife in such a way that the direction of movement of the scaife (tangential movement) makes an appropriate angle with a given crystallographic direction or grain direction in that facet.

Apart from this, the holder must be movable towards and away from the working plane, and one must determine its movement towards the working plane very accurately so as to know when the facet has been worked to the appropriate depth (accuracies of up to 2.5 um may be required for polishing diamond facets). When working has occurred to the correct depth, the stone must be raised from the working plane, the grain orientation and facet changed, and the stone gradually returned to the working plane with no or low pressure to avoid damage to the stone or to the working member. Subsequent to this, sufficient working pressure must be exerted to allow the working to proceed at an acceptable rate.

Working facets is often accompanied by a reciprocatory motion of the stone transversely across the working member, i.e. radially of a scaife, to even the wear of the working member and keep the facet smooth—this motion is called zooting herein.

THE INVENTION

In accordance with one aspect of the invention, the stone mount is held in a gimbal arrangement, for pivoting about first and second axes which intersect a third axis, the axis of the mount, at substantially the same point.

The word "mount" is used as it is normal practice to provide a tubular or sleeve-like mount when the polishing machine is manufactured and sold, though the stone holder can be supplied separately and then inserted in the mount and fixed in a definite orientation with respect to the mount. However, it is understood that the mount could comprise the holder. The mount is restrained in various ways so that the mount can be properly located in position and the grain orientation and facet position can be changed. The grain orientation is changed by rotating both the mount axis and the first axis synchronously about a fourth, normal axis, normal to the working plane; the facet position can be changed by rotating just the first axis about the normal axis, both the facet position and grain orientation can be changed by rotating just the mount axis about the normal axis (fhe facet position being changed in the other direction), it being understood that the facet position is changed whenever there is relative rotation about the normal axis between the mount axis and the first axis. Thus provision is made for changing the grain orientation and changing the facet position, and this does not interfere with the pivoting of the mount about a working axis parallel to the working plane so that the stone can move towards and away from the working plane and the angle and depth of working can be properly controlled. Depending on the orientation of the axes, the pivoting about said working axis can be simple pivoting about the first or the second axis, or a composite pivoting about both the first and second axis.

Though not provided for in the preferred embodiment of the invention, it would be possible to change a facet position by swinging the mount, and hence the mount axis, about the first axis until its inclination to the working plane was equal and opposite to that previously, and then rotating both the mount axis and the first axis about the normal axis through 180°.

The advantages of the machine can be as follows:

The indexing systems for grain orientation and facet position are integrated, and this can reduce the weight of the mechanisms required. Although the adjustment of the facet position or angle requires two independent movements, these movements can be suitably coordinated. The indexing systems are simple and thus the machine can be inexpensive. Also all the fine tolerances are in one part, namely the holder or mount and the pivot bearings of the mount, which can simplify manufacture. It is found that a machine in accordance with the invention can polish accurately, producing stones of good quality, with facets which are smooth and free from polishing lines and meeting correctly to form the culet. The machine can perform well as an 8-cut polishing machine, even for small sized stones down to say 0.01 metric carat (girdle diameters about 1.4 mm), so that the eight facets polished by the machine can form the finel eight pavillion facets of a round brilliant-cut stone, the quality of the polished facets being important as well as the speed and accuracy of the polishing operation (1 metric carat=0.2 g). As a development of the invention, it may be possible to use the machine to fully cut brilliant-cut diamonds, i.e. polish all the facets on the culet and table sides, with the exception of the table itself. The machine can be used for polishing or blocking larger stones, say of 0.1 carat or heavier.

A great advantage of the machine is that it enables the mass which moves with the stone to be greatly reduced even in a fully-automated machine, and the stone holder or mount can pivot freely—in a fully-automated machine, the grain and/or facet motors can be fixed and need not move with the stones and even in a manual machine, the adjustment device need not move with the stone. This is valuable even if facet changing alone is required (and not grain orientation changing).

The pivotal motion of the mount could be arranged for instance using a spherical bearing with a guide pin and slot for restraint, but it is preferred to use a gimbal. The gimbal can be relatively light so that the mass of the components that are actually tracking the scaife (i.e. moving up and down with the diamond when irregularities on the scaife are met) can be kept small, reducing scaife damage and making polishing more efficient.

More generally, the mount and any part(s) connected to the mount so as to participate in the motion of the mount as the stone moves away from the working plane, can have such a mass that a force of 0.2N (Newtons) or less, and preferably 0.1N or 0.05N or less, in a direction away from and normal to the working plane must be applied to the stone to accelerate it at $1m/s^2$ in said direction. Though the force of 0.2N (for an acceleration of $1m/s^2$) can be exceeded, significantly better performance is achieved as said force is reduced. A low force allows the stone to follow any vertical irregularities on the scaife without inducing large accelerating forces, the stone riding easily over any small irregularities on the surface of the working member. Not only does the machine reduce the force required to lift the stone, but it reduces the impact of the stone on the working member when it returns as the machine head does not flex significantly in an elastic manner. The machine can significantly reduce damage to the working member and to the stone. When the stone is being worked, there is at any one instant a normal force (giving rise to the working pressure) on the stone, composed of the static forces due to any unbalanced weight of the mount and said part(s) and any spring force applied, and dynamic forces due to irregularity of the working member (acceleration forces) and the relationship of the mount axis to the direction of movement of the working member (which latter can cause a certain amount of digging in). The acceleration forces depend inter alia on the moment of inertia of the mount and said part(s), as well as on the inclination of the mount axis to the working plane. The acceleration of 1 m/s is about double that produced by a 3000 r.p.m. scaife having a sinusoidal irregularity, extending right around the scaife with one crest and one trough, the crest to trough height being 10 $\mu$m.

Unless other compensation is arranged, the two rotational axes of the gimbal (i.e. the first and second axes) should intersect, i.e. be coplanar, and should intersect the mount axis at the same point, so as to ensure that the facets are true, though some tolerance is permitted, such other compensation could however be arranged for instance using a micro-processor, allowing the first and second axes (and the mount axes) to cross rather than intersect providing the distances apart of the axes are slight (whether a gimbal or another arrangement is used). In order to simplify the geometry of the machine head, it is preferred that the second axis be substantially perpendicular to both the mount and the first axes, but this is not believed to be essential. As orbital movement of the intersection of the first and second axes is not damaging (provided it is not too great), the normal axis need not pass through said intersection or intersect any of the first, second and mount axes.

The gimbal is preferably formed by pivoting the mount to a first element about the second axis and pivoting the first element to a second element about the first axis, the first element being freely movable apart from the restraint of the pivots. The second element is locatable about the normal axis, and can be in the form of a ring gear, e.g. driven by an external pinion. The mount must be located as regards movement about the normal axis, and the mount can be connected to a third element which is also rotatable about the normal axis in such a way that movement of the third element about the normal axis is transmitted to the mount, the third element thus locating the mount about the normal axis. In this way, if the third element remains stationary, rotary movement of the second element causes the mount to twist about the mount axis (which will normally be coincident with the axis of the stone). The third element can be in the form of a ring having a radial slot through which the holder passes as a close fit, preventing circumferential movement of the holder with respect to the ring but allowing the holder to twist and pivot.

The second and third elements could be independently drivable, but it is preferred to incorporate a clutch between the two elements, driving only say the second element. Thus if the clutch is engaged, both the second and third elements rotate and the grain orientation is changed and if the clutch is not engaged, only the second element rotates and the facet position is changed.

The first axis is preferably as close as practicable to the working plane. As a development of the machine it is believed that an automatic grain-seeking facility can be incorporated, e.g. using the rate of cut principle disclosed in GB Pat. No. 2 037 196A.

According to another aspect of the invention, a position indicator is incorporated on a pivoted mount but remote from the stone, with sensing means for sensing the position indicator.

Apart from the initial setting up of a new holder, it is not necessary to bring the holder into contact with the working member (compare with GB Pat. No. 1 206 937); the scaife thus does not get significantly coated with metal from machining the holder. Nonetheless the mechanical path between the stone and the position indicator is not excessively long and the machine can be suitable for diamond polishing.

The scaife does not have to have a good conducting surface, i.e. the scaife can be prepared as desired and can be covered with a relatively thick film of oil, and it is not necessary to avoid a thick layer of insulating grit.

In general, the length of the mount will be critical, and substantial thermal expansion should be avoided, for instance by using low expansion or expansion compensated materials, keeping the work pressure sufficiently low, or reducing the working pressure prior to the facet being finished. However, the position indicator can be reasonably close to the working plane so that the mount is not very long, thereby reducing inaccuracies.

The sensing means preferably comprises a surface extending parallel to the working plane, with which the position indicator cooperates. Such a sensing means surface would be fixed in the sense that it remains parallel to the working plane in all positions of the third axis, i.e. the mount or holder axis. In effect, the scaife and the sensing surface are two parallel planes, and the distance of the stone to the position indicator is fixed, so that sensing must occur at the correct facet angle and depth. Strict parallelity is not essential, providing the error is slight and is compensated for—for instance, lack of parallelity could be compensated for by a micro-processor.

In a preferred arrangement, the position indicator is an electrical contact which engages a fixed contact. However, other arrangements are possible, for instance, the end of the mount remote from the position of the stone could be connected by a short link roughly at right angles to the mount axis to a linear transducer—this has an added advantage that the linear transducer could give a signal indicating the rate of descent, thereby indicating whether the grain orientation was correct or not and enabling automatic grain seeking to be incorporated—furthermore, as an alternative or an addition, the linear transducer could signal when faceting is nearly complete, say at 10 or 20 μm before the finish, for instance the working pressure then being automatically reduced. As a further possibility for improving the quality of the culet, it would be possible to use a zooting ring, i.e. a ring on the scaife boarted up (provided) with much finer grit than used for bulk polishing and possibly kept moistened with olive oil, the transfer from the normal (roughing) ring to the zooting ring being automatic and initiated by a suitable signal, for instance that given by the transducer.

According to a further aspect of the invention, the position of the mount and the working pressure are controlled by spring means linked to the mount. Control means are provided comprising a movable control member, a first end portion of the spring means being connected to the control member and a second end portion connected to the mount. The control member, and hence the spring means and the mount, moves from a first position in which the stone is not in contact with the working member and the spring means is in an initial state, to a second position in which the stone is in contact with the working member; the movement of the control member is then continued. The spring acts as a fixed link until the stone contacts the working member, providing accurate control of the lowering of the stone on to the working member. Until the stone makes contact with the working member, the spring is in its initial state, i.e. its tension does not alter, so that the stone can be arranged to touch down on the working member with negligible force, avoiding damage to the stone and to the working member. Subsequently, after the control member reaches its second position, the spring is stressed, applying working pressure to work the facet. The value of the maximum force applied to the spring depends upon the size and shape of the stone, but the force applied to the stone normal to the working plane is typically between 0.5 and 1.5 kg. The control member can be actuated by a drawing mechanism such that it draws the spring gradually away and then stops; subsequently, as material is removed from the stone, the holder will move in the direction of the force applied by the spring, thereby decreasing the stressing of the spring and decreasing the force applied. This reduces the danger of damage to the stone which can occur upon sudden removal of the stone on completion of a facet. If more complex monitoring is used (such as the transducer referred to above), the drawing mechanism could comprise a stepper motor which reverses when faceting is nearly complete, not only enabling pressure to be reduced towards a completion of a facet but also enabling one to alter the maximum tension for different stone sizes.

As a spring is being used instead of gravity to apply the working pressure, better following of the scaife surface can be achieved, in addition, no large mass is required, so that the inertial effect referred to above is considerably reduced—the holder and the parts moving therewith can have a very low mass. Another advantage of using spring pressure is that it is possible to arrange the machine with the working plane other than horizontal, and can permit for example the use of a number of scaives on a single horizontal shaft.

The other end of the spring can be attached to any suitable member for controlling the spring, the simplest and preferred form being a ratchet drive—other possibilities are to use a solenoid with a variable current or a motor and rack which applies a variable stress to the spring—in both cases, the spring avoids the inertia of the solenoid or motor being transferred to the holder. A solenoid can be incorporated to provide a rapid lift at the end of working.

In a convenient arrangement, the mount (which comprises or receives the holder) passes through a ring relative to which it can rotate, the spring being connected to the ring.

DESCRIPTION OF PREFERRED EMBODIMENT

The invention will be further described, by way of example, with reference to the accompanying drawings, in which.

Figure 1:
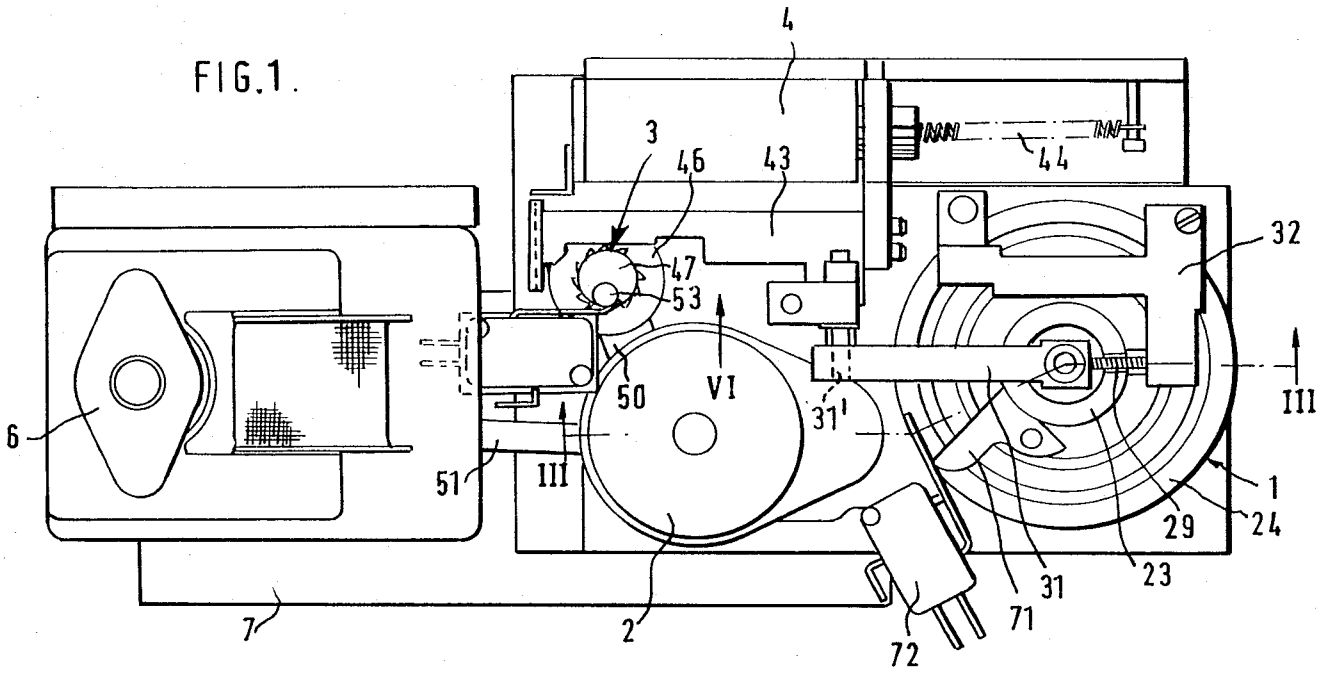
FIG. 1 is a schematic plan view of a gemstone polishing machine in accordance with the invention, to indicate the lay-out of the parts.
Figure 2:
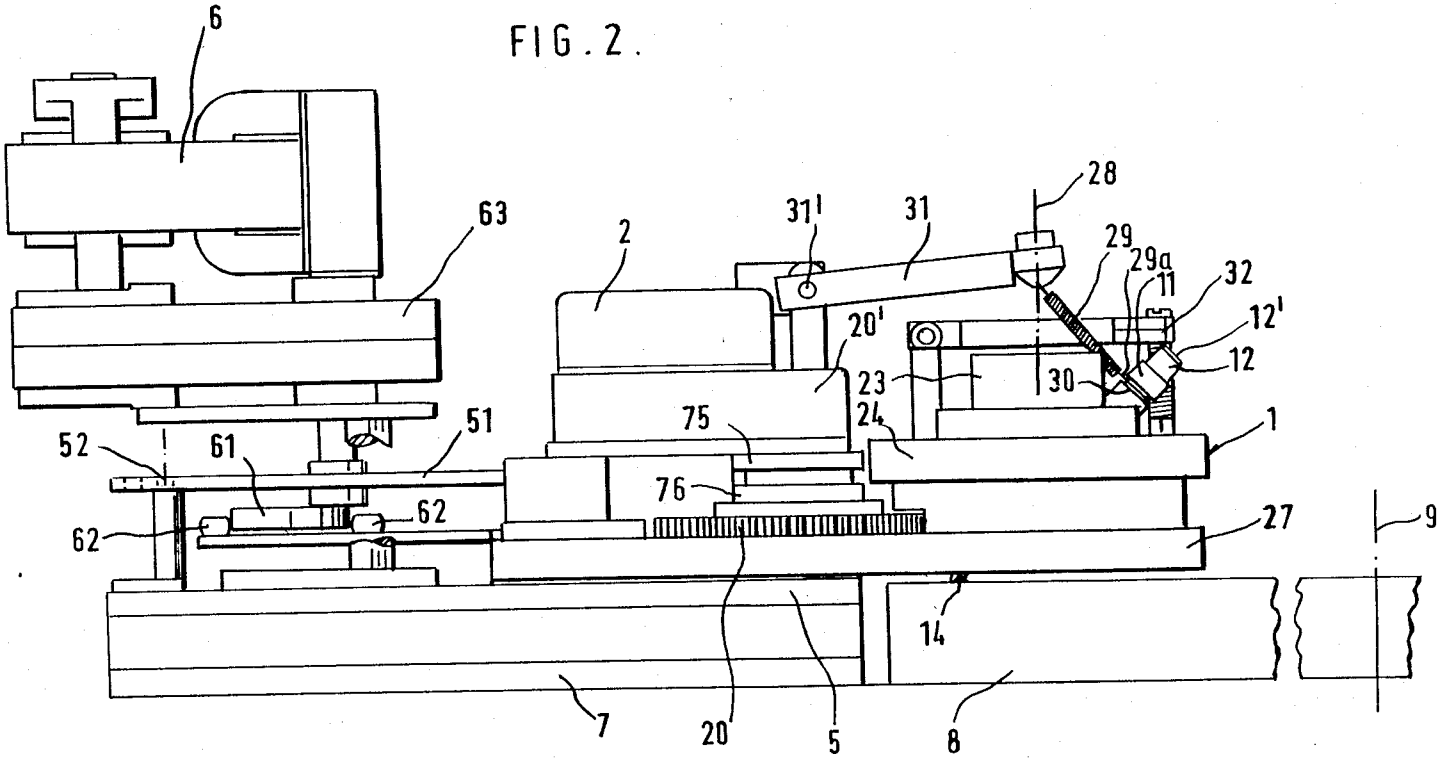
FIG. 2 is a schematic elevation corresponding to FIG. 1.

FIGS. 1 and 2 show a head 1 with its drive motor 2, a ratchet mechanism 3 with an associated double solenoid 4, and a slideway 5 and associated zooting motor 6, all mounted on a plate 7. The plate 7 can be bolted in position in a polishing unit, a scaife 8 with its axis 9 being indicated in FIG. 3. The scaife 8, its holder and its motor (not shown) can be conventional. Vertical adjustment is provided of the plate 7 and/or of the scaife 8.

Figure 4:
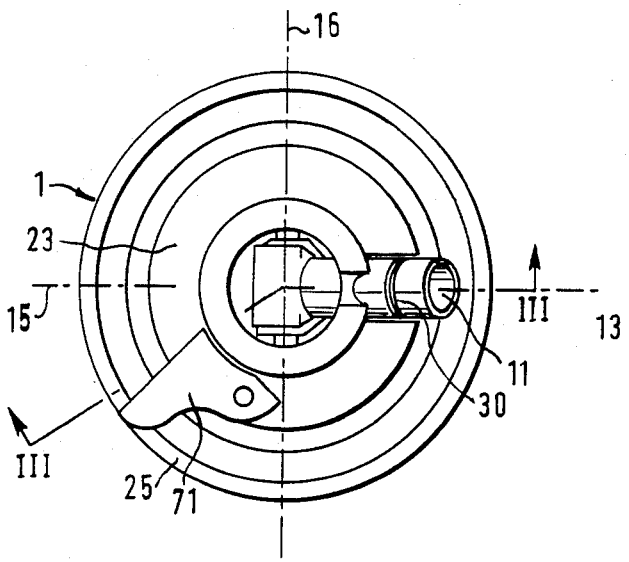
FIG. 4 is a plan of the head of FIG. 3, with the cover removed.
Figure 5:
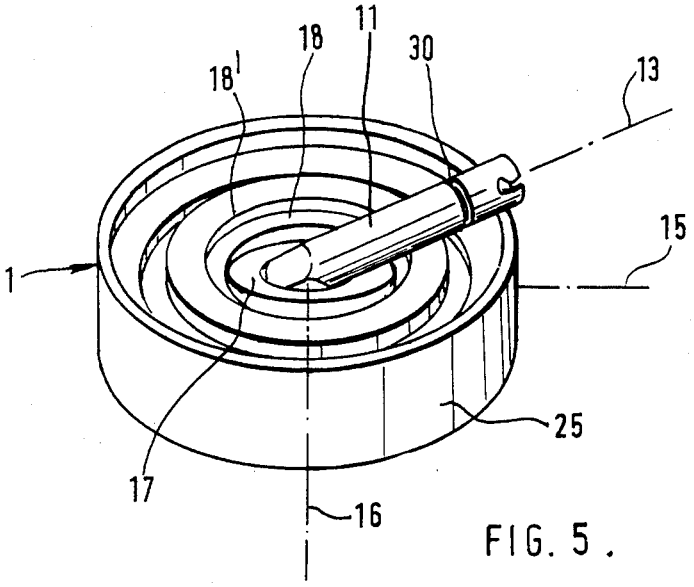
FIG. 5 is an isometric view of the head, with the cover and top ring removed.

The head 1 (FIGS. 3 to 5) comprises a mount 11 in the form of a hollow tube which receives a stone holder 12. Suitable stone holders are well known. The mount 11 is capable of motion about three axes, namely: a mount axis 13 which passes through the diamond 14, is coincident with the axis of the diamond 14, and is inclined to the working plane (the top surface of the scaife 8); a first, horizontal gimbal axis 15 which lies in a plane parallel to but spaced above the working plane; and a second gimbal axis 16 which is perpendicular to the mount axis 13 and also to the horizontal gimbal axis 15 (through the three axes are not usually mutually perpendicular). This is achieved by providing pivot means in the form of a gimbal, comprising a first element in the form of a gimbal ring 17 pivoted to the mount 11 about the second axis 16 and a second element in the form of a steel collar 18 pivoted to the gimbal ring 17 about the horizontal axis 15. Subject to the restraint of the pivots, the mount 11 can twist about its own axis 13.

The collar 18 is fixed to a gear ring 19 supported on a washer 19'. The gear ring 19 can be rotated or indexed by means of a pinion 20 connected to the motor 2 via a gear box 20'. A suitable motor is a 2 r.p.m. motor.

Figure 3:
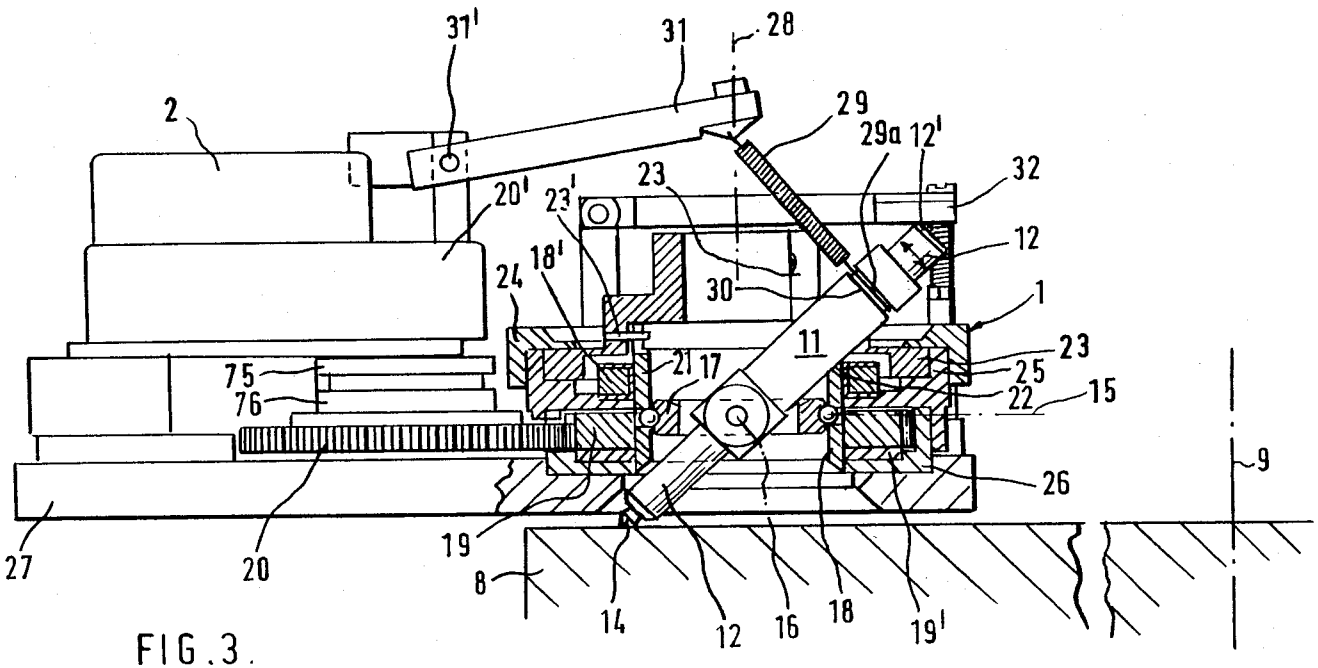
FIG. 3 is an enlarged view, partly in section along the line III—III in FIGS. 1 and 4, showing the head.

Above the collar 18 is a steel grain ring 21 which has a slot 22 whose sides are very close to the mount 11 which allowing the mount 11 to twist about its axis 13, the slot 22 also permits the mount 11 to pivot about the second gimbal axis 16, as indicated by the double arrow in FIG. 3. There is a slotted cover 23 located on the grain ring 21 by a pin 23' and retained by a brass cover 24. The cover 24 is fixed to a brass body 25 fixed in turn to a brass base support 26. The head 1 is mounted on a slide 27 carried on the slideway 5 for zooting motion.

Between the grain ring 21 and the collar 18 there is a magnetic clutch 18', which when engaged causes the grain ring 21 to move synchronously with the collar 18 and gear ring 19. The design is such that friction applies a light brake to the grain ring 21 so that if the clutch 18' is disengaged, the grain ring 21 will remain stationary as the collar 18 and gear ring 19 are indexed (separate light brake could be provided, if necessary). Movement of the grain ring 21 about a vertical (normal) axis 28 normal to the working plane is transmitted to the mount 11. In this way, the motor 2 can be used to alter the position of the horizontal axis 15 about the vertical axis 28, and, if the clutch 18' is engaged, also the position of the mount axis 13 about the vertical axis 28; the effect of altering the positions, or indexing, the mount and horizontal axes 13, 15 has been explained above. In order to ensure that the facets meet precisely at the culet point, the axes 13, 15, 16 should mutually intersect, though tolerances are permitted, depending on the accuracy of polished required. It is convenient if the normal axis 28 passes through the point of intersection, though not essential.

In use, the mount 11 pivots about the horizontal axis 15 and/or the second axis 16, but its pivoting motion is restrained by a helical spring 29*a* connected to a ring 29' which is freely rotatable upon the mount 11. The ring 29*a*' is axially located by a shallow annular groove 30 in the mount 11 (see FIGS. 4 and 5). Preferably the ring 29*a*' is formed by an end loop of the wire from which the spring 29 is made (though the end of the spring 29 could be hooked into an eye in a separate ring). At a point on the vertical axis 28, the spring 29 is connected to a control member in the form of a lever arm 31 pivoted at 31'.

The moment of inertia of the holder 12 and the parts connected thereto so as to participate in the motion of the holder 12 as the diamond 14 moves away from the working plane is roughly $10^{-5}$kgm$^2$—such parts are the mount 11, gimbal ring 17 and the spring ring 29*a*', ignoring the diamond 14 and treating the mass of the spring 29 itself as insignificant. The vertical force required to accelerate the diamond 14 vertically at 1 m/s$^2$ is roughly 0.04N when the axis 13 of the holder 12 is such as to work a 41° facet.

The pivot bearings of the head 1 can be protected from diamond dust by a cover (not shown).

Above the top end of the holder 12 there is a contact bar 32, which, as shown in FIG. 1, is shaped so as to extend over both portions of the top end of the holder 12. In principle, there could be a complete annulus, but in practice the holder 12 only has to assume two different positions for a four-point sawn, eight-cut diamond. The contact bar 32 is fixed and lies in a plane which is strictly parallel to the working plane (whatever the position of the mount axis 13), and adjustments can be provided to achieve this. It can be seen from FIG. 3 that if the contact bar 32 is at the correct height, contact is made between the chamfered part 12' of the top end of the holder 12 and the bar 32 when the facet has been worked to the correct depth. The chamfered part 12', which is adjacent the mount axis 13 and is circular and centered on the mount axis 13, thus acts as the position indicator. As in the case of the contact bar 32, the position indicator could just be part circular, though a full circular shape is easier to machine. For facets of different angles, the angle can be altered by for instance altering the height of the scaife 8, altering the height of the head 1, altering the height of the contact bar 32, and/or altering the length of the holder 12. In all cases, the contact bar 32 is reasonably close to the working plane.

Figure 6:
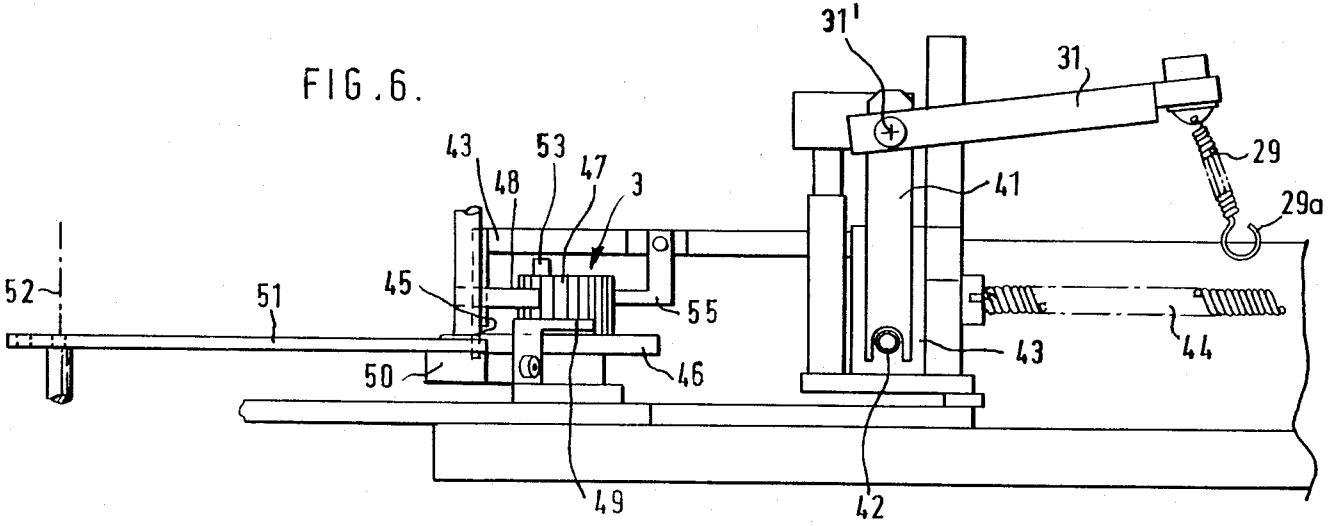
FIG. 6 is an enlarged view in the direction of the arrow VI in FIG. 1, showing the ratchet mechanism.
Figure 7:
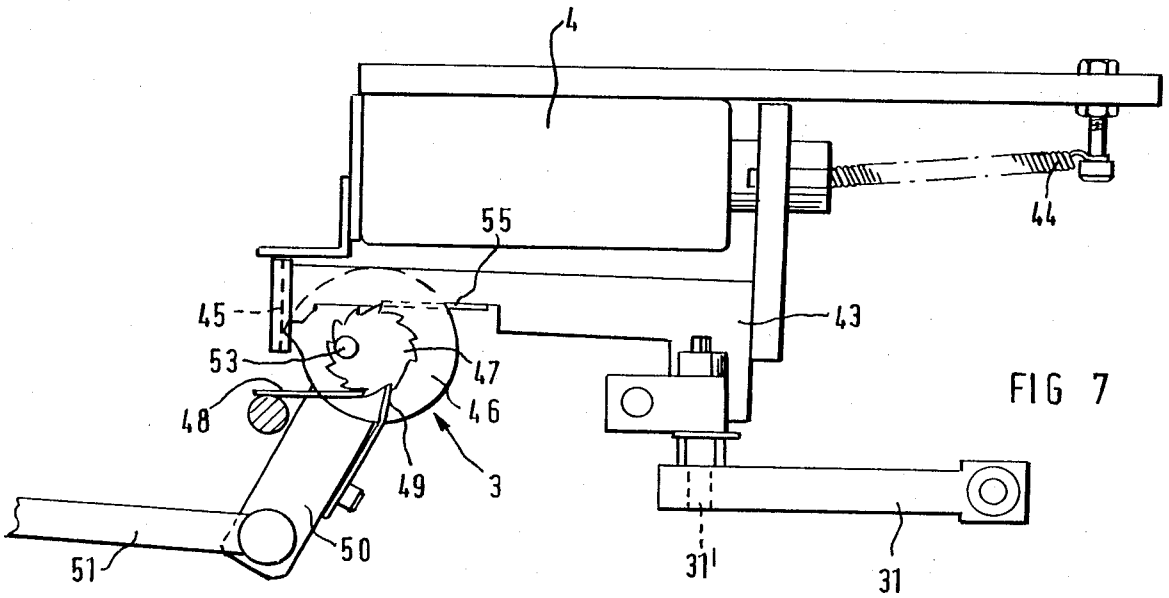
FIG. 7 is a plan of the ratchet mechanism of FIG. 6.

The position of the lever arm 31 is controlled by the ratchet mechanism 3 (FIGS. 6 and 7). The lever arm 31 is pivoted at 31' but is fixed to a drop arm 41 which engages a pin 42 on a slide 43, sprung towards the right (lever arm 31 raised) by a tension spring 44. The slide 43 has a cam follower face 45 which is pulled against a vertical axis rotary cam 46, thereby determining the position and motion of the slide 43. The cam 46 is fixed to a ratchet wheel 47 having a leaf spring stop 48. The ratchet wheel 47 is turned anticlockwise by a leaf spring 49 fixed to a swinging link 50 articulated to the end of a push rod 51 in turn pivoted at 52 on a fixed vertical axis; the swinging link 50 swings about the axis of the ratchet wheel 47. The ratchet wheel 47 is thus advanced by the zooting motion. There is however a tooth missing from the ratchet wheel 47 (see FIG. 7) so that when the cam 46 reaches its position of minimum radius, the ratchet wheel 47 ceases to turn. When this occurs, the working pressure on the diamond 14 is reduced as the facet continues to be polished down and the spring 29 relaxes somewhat. There is a microswitch actuator 53 on the top of the ratchet wheel 47.

The slide 43 has a leaf spring detent 55 which engages the ratchet wheel 47 when the slide 43 is in its right-hand position (cam 46 in position of minimum radius).

The slide 43 is connected to the armatures of the double solenoid 4. When the solenoid 4 is energised, the slide 43 is pulled to the left and the detent 55 advances the ratchet wheel 47 one tooth so that the spring 49 no longer 'engages' the missing tooth and the cam 46 engages the face 45 with its high lift lobe (position as shown in FIG. 7).

The zooting motion is caused by an eccentric 61 (FIG. 2) engaging follower faces 62 connected to the slide 27, the eccentric 61 being driven by the motor 6 via a gear box 63. Any suitable stroke length and frequency can be used, possible values being 20 mm and 30 cycles/min.

The holder 12 and the contact bar 32 are included in an electrical circuit (see FIG. 8), the arrangement being such that when contact is made, the solenoid 4 is actuated and the diamond 14 is lifted off the scaife 8. A capacitor/resistor circuit 70 is incorporated in association with the contact bar 32, so that contact must be maintained for a predetermined period of time, say 0.25 sec before end of working is signalled, to avoid spurious signals due to uneveness of the scaife 8.

Figure 8:
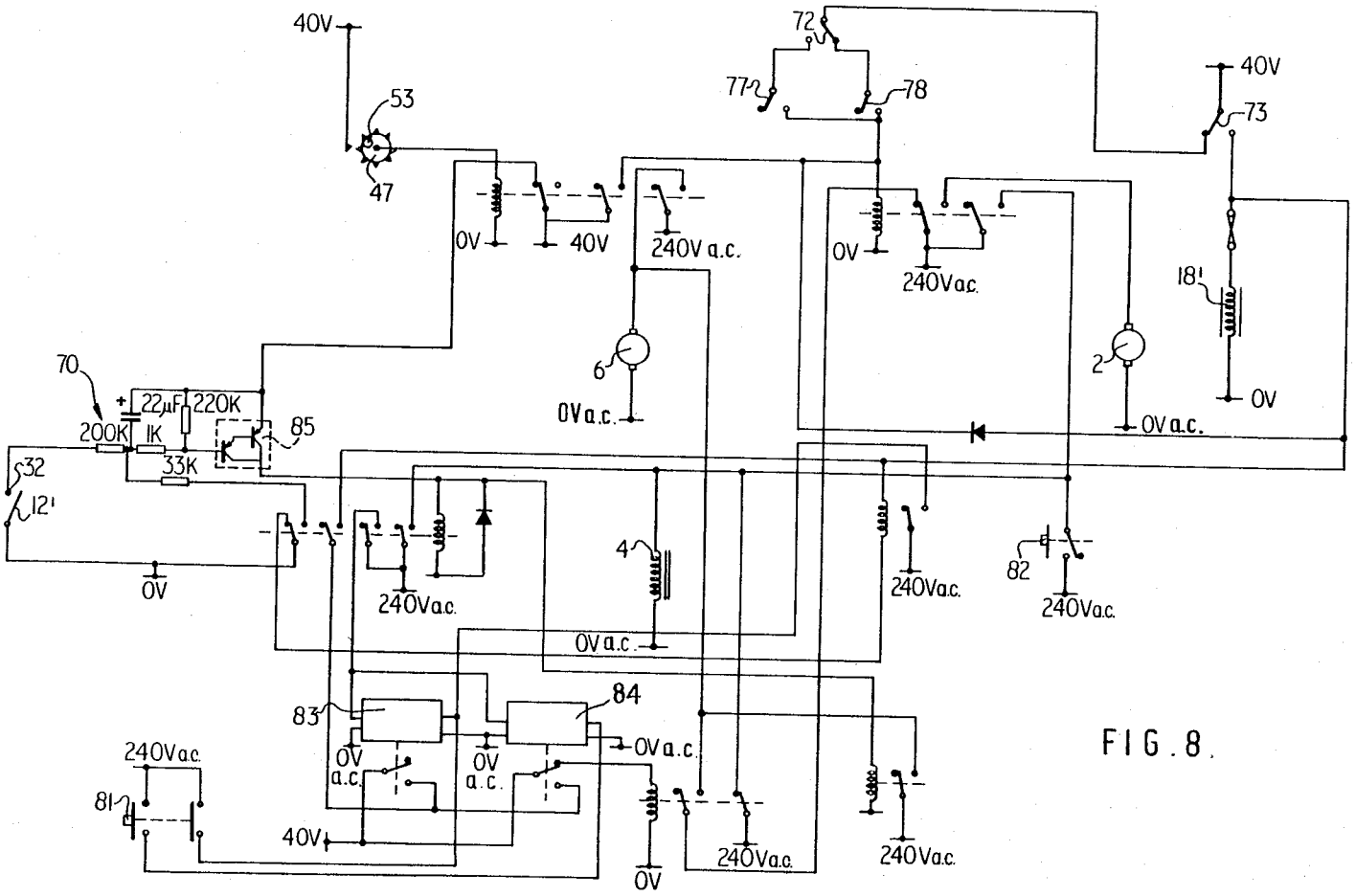
FIG. 8 shows the electrical circuit associated with the machine.

Regarding the control of the head 1, it would be possible to monitor the rotations of the gear ring 18 and grain ring 21 using encoder wheels, and the whole operation could be controlled by a microprocessor. However, in the simple arrangement described, the grain ring 21 carries a small actuating arm 71 which actuates a microswitch 72 (FIG. 1) to indicate in which of the two grain positions (8 o'clock or 12 o'clock) the grain ring 21 is set. A microswitch 73 is actuated by either of two detents (not shown) on the grain ring 21 indicate that the grain ring 21 is in one of the two grain positions. Two wheels 75, 76, each with four detents, are mounted on the shaft of the motor 2, and are monitored by two microswitches 77, 78 to indicate the amount of rotation of the gear ring 19 required to position the next facet. The microswitches 73, 77, and 78 are not shown in FIG. 1 or 2, for simplicity, but are indicated in FIG. 8. The detents on the grain ring 21 and on the wheels 75, 76 are not shown, but if those cooperating with the microswitch 77 are positioned at 0°, 90°, 180° and 270°, those cooperating with the microswitch 78 will be positioned at 8°, 82°, 188° and 262°. If the arm 71 on the grain ring 21 is at 0°, the detents on the grain ring 21 will be positioned at 0° and 225°.

To change a facet, the grain ring 21 is held braked while the gear ring 19 is rotated, the rotation being monitored by the microswitch 77 for the 12 o'clock facets or 78 for the 8 o'clock facets, the microswitch 72 directing power to the appropriate which, the microswitch 77, 78 switches off power when the new facet has been found. The angles through which the gear ring 19 has to rotate can be calculated by solid geometry—for instance, starting with the gimbal ring 17 parallel to the working plane (scaife 8), a 53° rotation of the gear ring 19 is required to rotate the mount 11 through 45° (change to next facet) while a 90° rotation of the gear ring 19 is required to rotate the mount 11 through 90°.

When the grain orientation must be changed, the clutch 18' locks the gear and grain rings 19, 21, the microswitch 73 switches off power when the required grain orientation has been found. In detail, in accordance with normal practice, the four 12 o'clock facets are polished before the four 8 o'clock facets as this saves polishing time.

Figures 9, 10:
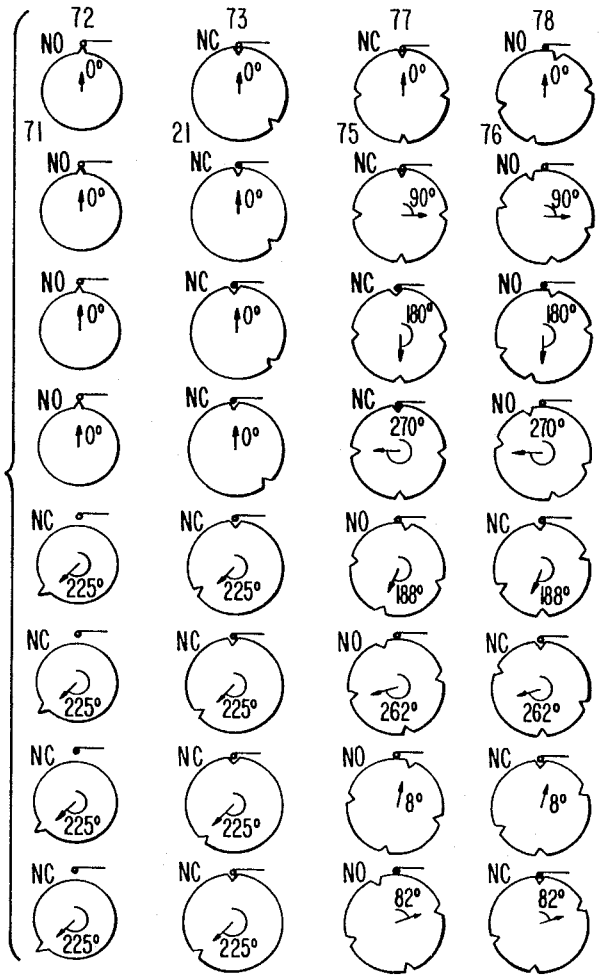
FIG. 9 is a diagram illustrating the operation of certain microswitches employed in the invention.
FIG. 10 is a table in which the condition of the microswitches illustrated in FIG. 9 is given for different facet numbers, grain change angles, and facet change angles.

Referring to FIGS. 9 and 10, of the eight facets polished on a stone by the machine, four are polished along the so-called "12 o'clock" grain and four along the "8 o'clock" grain, the four "12 o'clock" facets being polished first. With the machine operating in the "12 o'clock" grain position, the axial rotation of the stone which is required to present to the scaife the next facet to be polished is controlled by the detented wheel 75 actuating the microswitch 77. For the "8 o'clock" grain position, the axial rotation of the stone is controlled by the detented wheel 76 actuating the microswitch 78. In the "12 o'clock" position, arm 71 actuates the microswitch 72; in the "8 o'clock" position, it does not. As the microswitch 72 determines whether it is microswitch 77 or 78 which is in circuit, the axial rotation of the stone is controlled by the appropriate detented wheel for each grain position. The geometry of the gimbal arrangement requires different rotations of the gear-wheel in the two grain positions in order to change the facet, hence the need for two detented wheels 75 and 76.

When a grain rotation is required, the clutch is engaged so that rotation of the motor 2 causes the detented wheel 21 to rotate and so actuate microswitch 73. The new grain position has been reached when the next detent in the wheel 21 deactuates the microswitch 73.

When the machine is used with a new holder 11, the tips of the jaws of the holder 11 will be faceted (generally as described in GB Pat. No. 1 206 937), but thereafter no material will be removed from the holder 11, the faceted jaws will indicate the exact position of the girdle on a new bruted stone being inserted, thus assisting accuracy of faceting.

The details of the circuit of FIG. 8 will be understood by one skilled in the art, without detailed description. The circuit includes various components already described, as indicated with reference numerals, and also a prime button 81 (which is used to initiate the cycle), a manual "stone lift" button 82 (which is used to abort the facet), a ÷3 counter 83, a ÷8 counter 84 and a triggering circuit 85. All the relay contacts are shown in their at rest positions.

Instead of using a holder 12 which extends out of each end of the mount 11, it would be possible to use a short holder, say about 25 mm long, with a screw or bayonet fixing in the mount 11; the top end of the mount 11 can be suitably modified to make contact with the contact bar 32, e.g. having a part-spherical end providing a circular contact line. This gives the advantage that the diamond 14 can be inserted at the bottom.

Due to the design of the machine illustrated, it cannot polish facets at less than about 10°, though the 18° or 19° star facets can be polished.

I claim:

1. A gemstone polishing machine for working facets on a gemstone or the like, each facet having a grain orientation, using a moving working member which contacts the stone in a working plane, the machine comprising:

a mount for supporting the stone;

pivot means carrying the mount and restraining the mount to pivotal motion about two axes, namely a first axis which will lie in a plane substantially parallel to but spaced from the working plane, and a second axis which is at an angle to the first axis, the first and second axes substantially intersecting at a point at which they also substantially intersect a third, mount axis which is at an angle to the first and second axes and which will be substantially coincident with the axis of the stone and inclined to the working plane;

means for altering the position of the first axis in said plane parallel to the working plane by rotating the first axis about a fourth, normal axis normal to the working plane, and for locating the first axis in position; and means for altering the position of the mount axis by rotating the mount axis substantially about the normal axis, and for locating the mount axis in position;

whereby the grain orientation can be changed by rotating the mount axis and the first axis through the same angle about the normal axis, and the facet being worked can be changed by causing relative rotation about the normal axis between the mount axis and the first axis, the pivot means causing the mount to rotate about the mount axis due to the interaction of the restraints of the first and second axis pivotal motions.

2. The machine of claim 1, wherein the pivot means comprises a first element to which the mount is pivoted about the second axis, and a second element to which the first element is pivoted about the first axis, the first element being freely movable apart from the restraint of the pivots, the second element being rotatable about the normal axis.

3. The machine of claim 2, wherein the second element is rotationally fixed to a ring gear meshing with an external pinion, for indexing the ring gear.

4. The machine of claim 2, and further comprising a third element which is rotatable substantially about the normal axis, and means for transmitting to the mount movement of the third element about the normal axis, whereby the third element alters the position of the mount and hence the mount axis about the normal axis and locates the mount and the mount axis about the normal axis.

5. The machine of claim 4, wherein the third element comprises a ring having therein a slot through which the mount passes as a close fit.

6. The machine of claim 4 and comprising means for driving one of the second element and the third element and a clutch provided between the second and third elements for locking the elements together as regards rotary motion.

7. The machine of claim 1, and comprising means for changing the facet position by rotating the first axis about the normal axis and keeping the mount axis still while the mount rotates about the mount axis.

8. The machine of claim 1, wherein the second axis is substantially perpendicular to the first axis, and is also substantially perpendicular to the mount axis.

9. The machine of claim 1, wherein a force of no more than 0.05N in a direction away from and normal to the working plane must be applied to the stone to accelerate it at 1 $m/s^2$ in said direction.

10. The machine of claim 1, and further comprising a position indicator on the mount, said first and second axes lying between the position of the stone and the position indicator, whereby the position indicator moves as the stone is worn down during working, and means for sensing the position indicator to determine when sufficient work has been done on the facet being worked.

11. The machine of claim 10, wherein the position indicator is adjacent said mount axis and said sensing means comprises a surface extending parallel to the working plane, with which the position indicator cooperates.

12. The machine of claim 1, and further comprising:

control means for controlling the position of the mount and the working pressure between the stone and the working member, the control means comprising a movable control member, spring means having a first end portion connected to the control member and a second end portion connected to the mount, and means for moving the control member and hence the spring means and the mount from a first position in which the stone is not in contact with the working member and the spring means is in an initial state to a second position in which the stone is in contact with the working member, and for continuing the movement of the control member, thereby stressing the spring means from its initial state and applying a working pressure between the stone and the working member.

13. A gemstone polishing machine for working facets on a gemstone or the like, using a moving working member which contacts the stone in a working plane, the machine comprising:

a mount for supporting the stone, the mount being rotatable about an axis which will be inclined to the working plane;

an at least part-circular position indicator surface on the mount, adjacent the axis of the mount and remote from the position of the stone, the position indicator surface being centered on the axis of the mount;

means for supporting the mount for pivotal motion about an axis which lies between the position of the stone and the position indicator, whereby the position indicator moves as the stone is worn down during working, and for supporting the mount for rotary motion about its axis, whereby the facet being worked can be changed by rotating the mount about its axis, and sensing means for sensing the position indicator to determine when sufficient work has been done on the facet being worked, the sensing means comprising a surface of substantial extent extending parallel to the working plane at a fixed distance from the working plane and disposed for engagement with said position indicator surface.

14. The machine of claim 13, wherein the means for supporting the mount permits the mount to rotate about an axis normal to the working plane, thereby to assume at least two different positions, in each of which the position indicator sensing means is engageable by the position indicator.

15. A gemstone polishing machine for working facets on a gemstone using a moving working member which contacts the stone in a working plane, the machine comprising:

a mount for supporting the stone, the mount being movable so that the stone is movable towards and away from the working plane; and control means for controlling the position of the mount and the working pressure between the stone and the working member, the control means comprising a movable control member, spring means having a first end portion connected to the control member and a second end portion connected to the mount, and means for moving the control member and hence the spring means and the mount from a first position in which the stone is not in contact with the working member and the spring means is in an initial, substantially unstressed state to a second position in which the stone is in contact with the working member and the spring remains in said state, and for continuing the movement of the control member, thereby stressing the spring means from its initial state and applying a working pressure between the stone and the working member.

16. The machine of claim 15, wherein the mount is surrounded by a ring relative to which it can rotate, the ring being connected to the spring means.

17. The machine of claim 15, wherein the spring is a helical tension spring which, in its initial state, has its coils in tight contact with each other.

18. The machine of claim 15, wherein the control means is constructed so that a force of no more than 0.05N in a direction away from and normal to the working plane must be applied to the stone to accelerate it at 1 $m/s^2$ in said direction.

* * * * *